US006742453B1

(12) United States Patent
Borski

(10) Patent No.: US 6,742,453 B1
(45) Date of Patent: Jun. 1, 2004

(54) PRINTING SLEEVES AND METHODS FOR PRODUCING SAME

(76) Inventor: Mark Alan Borski, 1730 NW. 19th, Gresham, OR (US) 97030

( * ) Notice: Subject to any disclaimer, the term of this patent is extended or adjusted under 35 U.S.C. 154(b) by 0 days.

(21) Appl. No.: 09/744,824

(22) PCT Filed: Jul. 30, 1999

(86) PCT No.: PCT/US99/17427

§ 371 (c)(1),
(2), (4) Date: Jan. 29, 2001

(87) PCT Pub. No.: WO00/06393

PCT Pub. Date: Feb. 10, 2000

Related U.S. Application Data

(60) Provisional application No. 60/094,877, filed on Jul. 30, 1998.

(51) Int. Cl.[7] ..... A41C 1/00

(52) U.S. Cl. ..... 101/401.1; 101/375; 101/216; 101/395; 492/53; 492/56; 29/895.32

(58) Field of Search ..... 101/395, 401.1, 101/375, 376, 216; 492/56, 53; 29/895.32

(56) References Cited

U.S. PATENT DOCUMENTS

| | | | | |
|---|---|---|---|---|
| 3,081,168 A | | 3/1963 | Leekley et al. | |
| 3,146,709 A | | 9/1964 | Bass et al. | |
| 3,512,971 A | | 5/1970 | Floss et al. | |
| 3,516,828 A | | 6/1970 | Floss et al. | |
| 3,635,158 A | * | 1/1972 | Budinger | 101/147 |
| 3,836,709 A | | 9/1974 | Hutchison | |
| 3,978,254 A | | 8/1976 | Hoexter et al. | |
| 4,089,265 A | | 5/1978 | White et al. | |
| 4,119,032 A | | 10/1978 | Hollis | |
| 4,144,073 A | | 3/1979 | Bronstert et al. | |
| 4,144,812 A | | 3/1979 | Julian | |
| 4,144,813 A | | 3/1979 | Julian | |
| 4,269,930 A | | 5/1981 | Kress | |
| 4,298,680 A | | 11/1981 | Bruno | |
| 4,381,961 A | | 5/1983 | van der Velden | |
| 4,389,116 A | | 6/1983 | Vogel | |
| 4,391,898 A | | 7/1983 | van der Velden | |
| 4,446,222 A | | 5/1984 | Kress | |
| 4,478,931 A | | 10/1984 | Fickes et al. | |
| 4,554,040 A | | 11/1985 | van der Velden | |
| 4,571,798 A | * | 2/1986 | Adams | 100/176 |
| 4,642,283 A | | 2/1987 | Takahashi et al. | |
| 4,643,963 A | | 2/1987 | Hartmann et al. | |
| 4,868,090 A | | 9/1989 | Kitamura et al. | |
| 4,869,997 A | | 9/1989 | Koch et al. | |
| 4,871,650 A | | 10/1989 | Wallbillich et al. | |
| 4,903,597 A | | 2/1990 | Hoage et al. | |
| 4,906,551 A | | 3/1990 | Herrmann | |
| 4,985,301 A | | 1/1991 | Butters et al. | |
| 5,006,447 A | | 4/1991 | Umeda et al. | |
| 5,260,166 A | * | 11/1993 | Nazzaro et al. | 430/271.1 |
| 5,544,584 A | | 8/1996 | Thompson et al. | |
| 5,798,019 A | * | 8/1998 | Cushner et al. | 156/425 |
| 2002/0069777 A1 | * | 6/2002 | Rossini et al. | 101/401.1 |

* cited by examiner

*Primary Examiner*—Andrew H. Hirshfeld
*Assistant Examiner*—Kevin D. Williams
(74) *Attorney, Agent, or Firm*—Carmody & Torrance LLP

(57) ABSTRACT

The invention is directed to a method for producing a novel flexographic printing sleeve which is readily axially mountable on and dismountable from a complementary shaped printing cylinder. The subject method comprises providing an apparatus for receiving a sprayed curable polymeric material and for forming the flexographic printing sleeve. Then, the curable polymeric material is sprayed onto the apparatus and a flexographic printing sleeve is formed. The sleeve has a substantially unitary, non-laminated construction which is self-supporting. The cross-sectional inner and outer diameter of the flexographic printing sleeve is expandable by introducing a relatively low pressure fluid between the inner surface of the printing body sleeve and the outer cylindrically-shaped wall of the printing cylinder. The flexographic printing sleeve is contractible from its expanded position by releasing the low pressure fluid. The structural integrity of the flexographic printing sleeve is resistant to substantial damage or distortion.

21 Claims, 2 Drawing Sheets

PRINTING SLEEVES AND METHODS FOR PRODUCING SAME

This application claims the benefit of Provisional application Ser. No. 60/094,877 filed Jul. 30, 1998.

BACKGROUND OF THE INVENTION

This invention relates to printing sleeves which are readily mountable onto and dismountable from printing cylinders, more particularly to printing sleeves which are expandably mountable and dismountable employing a pressurized gas, and to methods for producing such printing sleeves.

In past printing operations, flexible printing plates were mounted onto the outer surface of a printing cylinder. These printing plates were used for printing of ink images onto a printing medium. Typically, the back of the printing plates were adhered directly to the printing cylinder. Since these plates were not readily interchangeable from one cylinder to another, the use of a multiplicity of printing cylinders to perform a multiplicity of jobs was required. This presented severe storage and cost problems to the end user.

Therefore, in an effort to overcome this problem, printing sleeves were developed which were mountable onto and dismountable from the printing cylinders. Compressed gas, generally compressed air, passing in a substantially radial direction from holes located within the printing cylinders, was used to expand the sleeve to a limited extent for facilitating the mounting and dismounting operations.

This latter mode of mounting and dismounting of a printing sleeve is described in U.S. Pat. No. 3,146,709. In that patent, a "wound" printing sleeve, i.e., a helically wound paper sleeve, is fitted onto a hollow printing sleeve. The printing sleeve is used as a carrier roll for rubber printing plates attached thereto. Air pressure is radially applied through the holes in the external surface of the printing cylinder for limited radial expansion of the sleeve. The sleeve is then axially mounted onto the printing cylinder by moving the cylinder to an upright position and filling the internal chamber of the cylinder with compressed air.

As the sleeve is moved over the upper end of the cylinder, the exiting air expands the sleeve and forms a lubricating air film between the inner sleeve and the outer cylinder. This air film permits axial mounting of the sleeve to a position about the cylinder. When the sleeve was in such a position, the airflow is terminated, and the sleeve is contracted forming an interference fit about the print cylinder.

However, difficulty has been encountered when wound sleeves are employed since expansion does not effectively take place unless high-pressure air, substantially higher than the 50–100 psi air generally available in production facilities, is radially conveyed between the sleeve and the printing cylinder to facilitate the mounting and dismounting operation. This expandability problem occurs because of the thickness of the sleeve walls and the nature of the materials of construction. If pressures above the available air pressure at the production facility are required to expand the sleeve, auxiliary sources of compressed air must be purchased. For example, in printing operations where sleeve thicknesses of about 0.015" or greater are required, such as in the modern flexographic printing industry, wound sleeves cannot readily be employed because they do not undergo the requisite expansion using available production compressed air. Furthermore, these wound sleeves cannot be effectively used because of the leakage problems inherent in their design, which in this case, U.S. Pat. No. 3,146,709, comprises a polyester film held in position by helically-wound paper tape. This type of construction forms a leakage path for the air and reduces the effectiveness of the lubricating fluid.

In order to overcome the problems inherent in the U.S. Pat. No. 3,146,709 wound printing sleeve, U.S. Pat. No. 3,978,254 provides for a mechanically adhered wound printing sleeve in which three layers of adhesive tape are helically wound about a mandrel to form a carrier sleeve, with two of the helixes being wound at the same angle and the remaining helix being wound at a different angle.

The convolution of the helixes is said to impart some degree of strength, rigidity and leakage protection to the printing sleeve. Neither of the printing sleeves of U.S. Pat. No. 3,146,709 or U.S. Pat. No. 3,978,254 is unitary in construction, but is instead fabricated of a composite of wound materials. The outer surface of the U.S. Pat. No. 3,978,254 wound sleeve also has a plurality of surface irregularities formed therein and is therefore not "round" to the extent required by the flexographic printing industry. These carrier sleeves are made of a flexible, thin tape material which provides a minimum of structural integrity, which exhibit minimal strength and durability properties. Moreover, as the printing plates are adhered to the printing sleeve they are moved from one position to another as they are aligned on the plate surface. In order to trim excess material from the plate from the sleeve surface, they must be cut with a sharp instrument such as a knife. The synthetic plastic tape used to form the above-described sleeve cannot withstand even the minor cutting action required in positioning of the printing plates.

Another type of printing sleeve is one which is made of a metallic material. As in the case of wound sleeves, metallic sleeves are not readily expandable and therefore must have a wall thickness which is be quite thin, i.e., thicknesses of up to only about 0.005", in order to be capable of undergoing the limited expansion required of printing sleeves. As indicated above, this minimum thickness level required of metallic sleeves is a problem in applications such as modern flexographic printing and the like. Moreover, printing metallic sleeves are not durable and are readily damaged. For instance, they can easily form kinks in their outer surface when they are stored without being supported by a printing cylinder.

Dimensional stability is a problem in printing applications requiring that the outer surface of a printing sleeve structure have a true cylindrical shape. In some cases, this true cylindrical shape must even be within a 0.001"–0.0025" tolerance level in order to be acceptable in, for example, uses such as in the process printing industry. The outer printing surface in these applications must accurately conform to a uniformly constant, cylindrical outer shape in order to accurately imprint a print image onto a printing medium. Many of the prior art printing sleeves do not meet these requisite tolerance levels.

U.S. Pat. No. 4,144,812 and U.S. Pat. No. 4,144,813 provide non-cylindrical printing sleeves and associated air-assisted printing rolls designed in a tapered or stepped-transition configuration, the change in the sleeve or printing cylinder diameter from one end to the other being progressive, i.e., increasing or decreasing according to the direction one is moving along the printing sleeve or roll. The printing roll comprises an outer surface having one end of a diameter greater than the other longitudinal end. The printing sleeve has an inner surface designed to form an interference fit with the outer surface of the printing roll only at the designated working position, and not along the entire axial uniform cross-sectional extent of the tapered sleeve.

This non-cylindrical sleeve is fabricated of a highly rigid material having a low degree of expandability. These sleeves have a thickness of at least about 0.015". An extremely high air pressure, in excess of 125 psi, and typically about 250 psi or higher, is thus required to be introduced as the sleeve is being fitted onto the underlying air-assisted, printing roll in order to extend the radial dimension of the printing sleeve to a position capable of achieving complete coverage of the printing cylinder by the sleeve. Complete coverage is required in this system to achieve a proper interference fit. Since a pressure in excess of 125 psi is required herein, the system must satisfy various governmental regulations relating to pressure-rated containers. Conventional cylindrically-shaped, air-assisted printing presently on hand cannot readily be retrofitted to accommodate this non-cylindrical configuration because they cannot meet the above-described pressure-rating requirement. Therefore, they must be replaced, at great cost, by new non-cylindrical printing cylinders capable of meeting these government regulations.

U.S. Pat. No. 4,119,032, describes an air-assisted printing cylinder mounted in a printing machine in such a way that a printing sleeve on its outer surface can be removed axially while the roll remains substantially in its working position. One end bearing of the printing cylinder is removably secured to a side of the machine frame. For axial positioning, an adjustable restrainer engages the roll axle at that end. Beyond the other side frame a counterpoise acts on the printing cylinder axle to support the printing cylinder when one end bearing is removed.

In U.S. Pat. No. 4,089,265, a flexographic printing roll is provided comprising a rigid base tube having perforations in the form of a plurality of small apertures and a printing sleeve on the tube strained to grip the tube to retain the sleeve securely on the tube. There is no underlying printing cylinder in the conventional sense in this system.

In order to overcome the aforementioned problems, a cylindrically shaped printing sleeve was produced according to the teachings of U.S. Pat. No. 4,903,597 ("US '597"). US '597, which has been assigned to the assignee of the present patent application, is incorporated herein in its entirety by reference.

The US '597 printing sleeve is unitary, substantially airtight, and can be frictionally mounted onto a conventional cylindrically shaped printing cylinders having a complementary cylindrical outside diameter. The US '597 sleeve can also be readily expandable using a low-pressure fluid and has a true outer wall surface capable of being used in modern flexographic printing applications.

The US '597 printing sleeves are typically fabricated of a polymeric material, and preferably comprise a reinforced, non-permeable laminate structure including at least one reinforcing internal layer of a woven fabric of synthetic fibers or organic fibers. Another internal layer may also be included which is non-permeable and is typically formed of synthetic fibers. Preferably, the synthetic and organic fibers are of high strength, and the reinforced non-permeable internal layers comprise a non-woven fabric of synthetic fibers.

The US '597 printing sleeve has been the state of the art product since the late 1980's. The presence of the US '597 sleeve in the marketplace has caused the overall printing sleeve business to grow significantly. This has lead others to develop alternative printing sleeves and printing sleeve manufacturing methods. For example, Dupont has developed a flexible Mylar printing sleeve system.

SUMMARY OF THE INVENTION

It has been recognized by applicants, in view of their experience in the print sleeve business, that although the US '597 printing sleeves remains intact as the industry standard, increased competition and higher costs of manufacture are now a commercial reality. Certain printing sleeves which have been developed in the last several years can exhibit certain physical properties which are even better than the US '597 printing sleeves. The aforementioned Mylar sleeves, for instance, have a higher affinity for having printing tapes (used in printing operations) adhered thereto. Also, the US '597 printing sleeves are presently being hand-built because the manufacturing operation is extremely difficult to automate. Therefore, producing the US '597 printing sleeves is very labor intensive. This can result in a relatively high manfacturing reject rate. Since material costs continue to rise, the overall manufacturing expense for the US '597 sleeves is relatively high as compared to new domestic and foreign companies who have entered the printing sleeve marketplace in the past several years.

There are also certain technical issues which have arisen regarding the U.S. Pat. No. '597 printing sleeves, as follows:

1. They are not as easily mountable as compared to certain competitive sleeves.
2. They lack surface adhesion advantages present in certain competitive sleeves.
3. They do not withstand certain high temperature applications required for the vulcanization of polymeric coverings now used in lazer engraving plate technology.
4. They do not have the durability that certain end users in the sleeve market demand.

Therefore, in an effort to supplement the present product line of US '597 printing sleeves, a new printing sleeve product and new method of manufacturing that new product have been devised. The new method of this invention comprises spraying of a novel polymeric composition as opposed to the process of US '597, namely, the formation of a laminate printing sleeve structure. No spray technology is available for spraying polymeric materials that have the desired properties to produce flexographic printing sleeves having the requisite physical and chemical properties. More specifically, no conventional material, either polymeric or otherwise, meets all of the product specifications for effectively and efficiently manufacturing high quality flexographic printing sleeves.

The subject printing sleeve comprises a combination of chemistries to produce a sleeve having both high temperature resistance and a high level of flexibility and machinability. The gel characteristics of the subject polymeric materials have been modified to achieve an extreme high-speed gel for sprayability. For example, the preferred polymer system of the invention herein employs a polyurea for high temperature resistance and a polyurethane for high flexibility and machinability. The preferred polymeric material is the SE-271 spray composition manufactured by Burtin Corporation of Santa Ana, Calif.

The printing sleeve of the present invention is formed of a substantially unitary construction unlike unlike prior art flexographic sleeves, such the US '597 sleeve, which are made of structural laminates. In fact, the printing sleeve of this invention comprises a non-laminate construction. Moreover, unlike prior art printing sleeves which require auxiliary structural reinforcing materials to impart structural integrity thereto, the flexographic printing sleeve of this invention includes no auxiliary structural reinforcing materials. This also results in better tape adhesion for mounting of printing indicia on the sleeve than in the case of U.S. Pat. No. '597. Because the new technology of this invention is made substantially solely of polymeric materials, when it is machined, there is a very smooth uniform outer surface which is produced. Contrarily, when the sleeve of US '597 is machined, it has microscopic fiber ends on the outer sleeve surface which interfere with, and limit, the adhesion of the common mounting tapes which are used in the application of printing indicia thereto.

The present invention is directed to a flexographic printing sleeve formed of a sprayed, cured polymeric material. In the preferred construction, the flexographic printing sleeve of the invention is formed of a plurality of layers of the curable polymeric material, which fuse together to produce a sleeve having a self-supporting substantially unitary construction.

This new type of flexographic printing sleeve is typically resistant to damage and distortion to its structural integrity at high processing temperatures. More specifically, this printing sleeve is damage and distortion resistant at a temperature of about 250 degree F., preferably at a temperature of about 275 degree F., and more preferably at a temperature of about 300 degree F.

Although the flexographic printing sleeve of this invention is produced by spray applications, and is not formed of a structural laminate construction, it nevertheless maintains distinguishing chemical and physical properties. For instance, it has a relatively low shrink rate (0.035% inhibited by tool), a high flexibility (10% elongation), and high strength and hardness (Durometer of 70 on the Shore "D" scale). The subject sleeve is also extremely durable and fracture resistant for long life. It also exhibits low porosity for good surface finish and has sufficient flexibility to be mounted easily on conventional print cylinders using low pressure air. It is also has sufficient strength and stiffness to not slip on the print cylinder under conventional flexographic printing conditions.

The printing sleeve of this invention exhibits a high level of environment compatibility since it contains no voc components or hazardous by products. Stated another way, the curable polymeric material employed in forming the subject printing sleeve typically comprises a non-solvent-containing sprayable curable polymeric material. Thus, no EPA permits are required to be maintained at the manufacturing site.

More specifically, the printing sleeve is preferably formed of a polymeric material which comprises a polyurethane-polyurea material. The material is preferably a blend of highly catalyzed polyurea and polyurethane sprayable at high temperature and high pressure to produce the flexographic printing described herein.

The flexographic printing sleeve is readily axially mountable onto and dismountable from a complementary shaped printing cylinder. The cross-sectional inner and outer diameter of the flexographic printing sleeve is expandable by introducing a relatively low pressure fluid between the inner surface of the printing body sleeve and the outer cylindrically-shaped wall of the printing cylinder. The sleeve is contractible from its expanded position by releasing the low pressure fluid. Typically, the subject method utilizes less than 100 psi fluid pressure to mount and dismount the flexographic printing sleeve of this invention.

The subject flexographic printing sleeve preferably comprises inner and outer cylindrically-shaped walls of substantially constant cross-sectional inner and outer diameter.

The printing sleeve of this invention has a wall thickness which is typically up to about 0.50", preferably up to about 0.45", and more preferably up to about 0.40", and most preferably up to about 0.35". By employing the method of the present invention, the subject flexographic printing sleeve can be formed in a manner wherein the average time for producing the sleeve is preferably not more than about 1.0 hour, more preferably not more than about 0.75 hour, and most preferably not more than about 0.5 hour. Stated another way, the method of this invention can form a non-laminated, substantially airtight, seamless, flexographic printing sleeve built with in a single spray application process that can be completed in a much shorter time period than presently commercially feasible in the marketplace.

DETAILED DESCRIPTION OF THE PREFERRED EMBODIMENT

Figure 1:
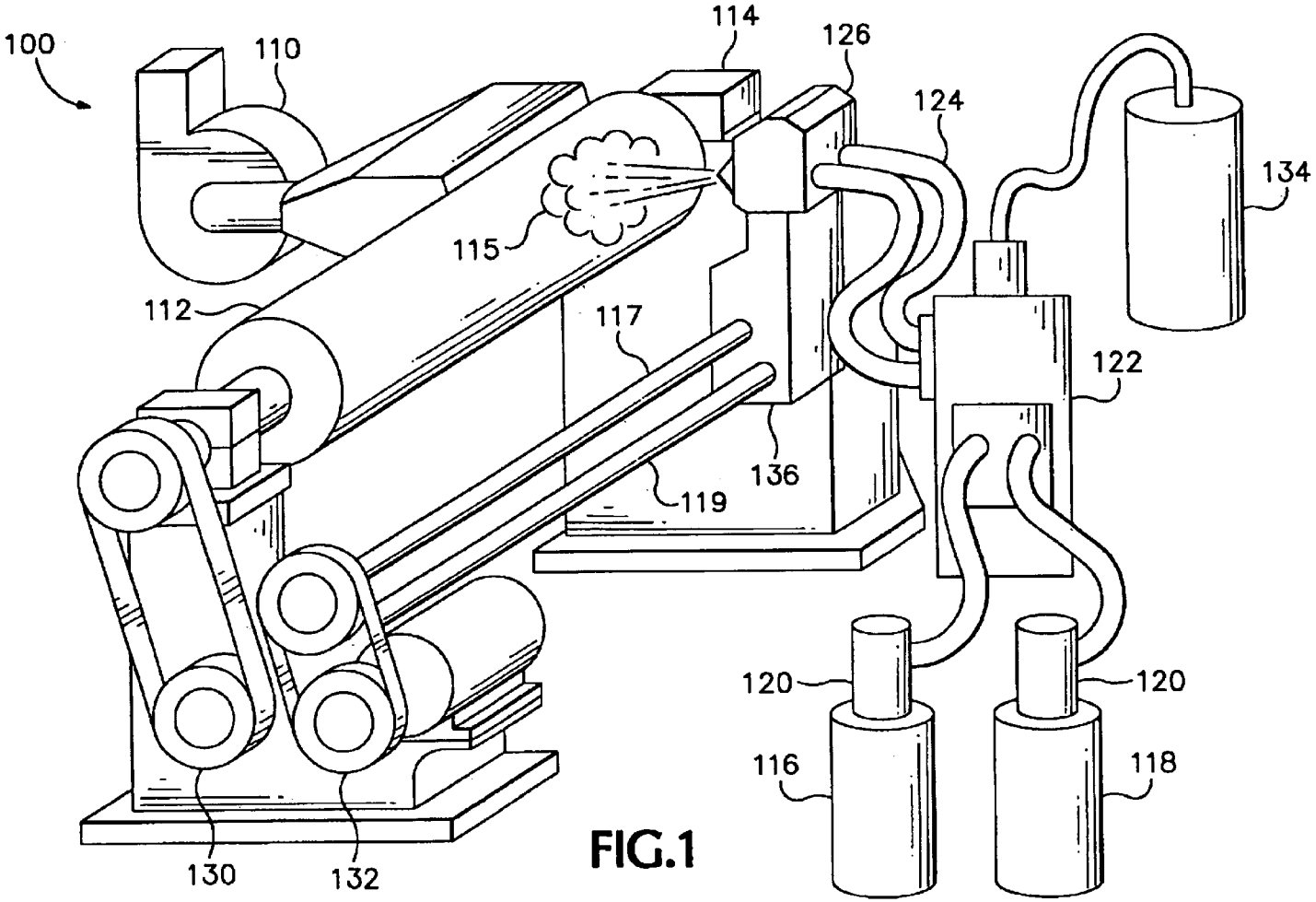
FIG. 1 is a pictorial view of an exemplary printing sleeve manufacturing system of the present invention.
Figure 2:
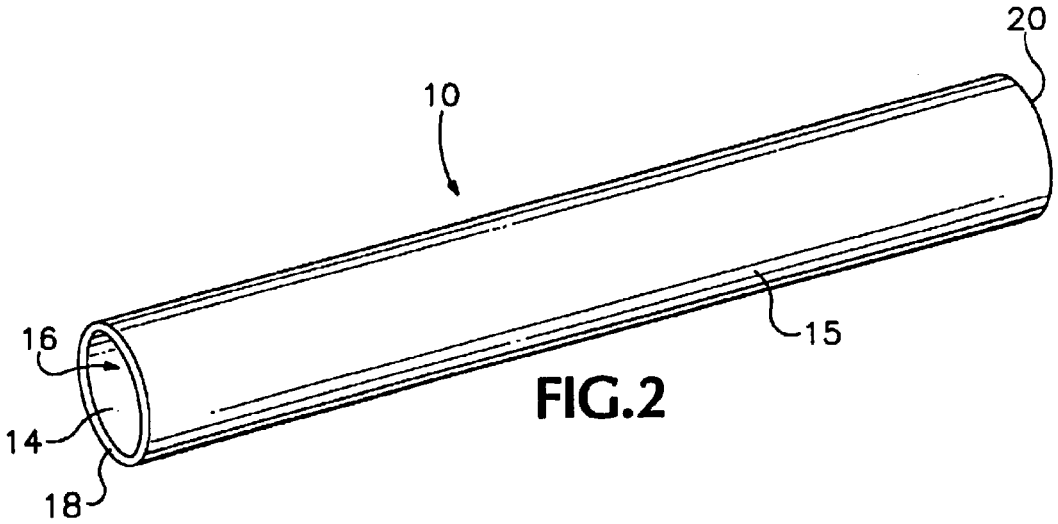
FIG. 2 is a perspective view of a flexographic printing sleeve of the present invention produced by the subject method such as by employing the system depicted in FIG. 1.
Figure 3:
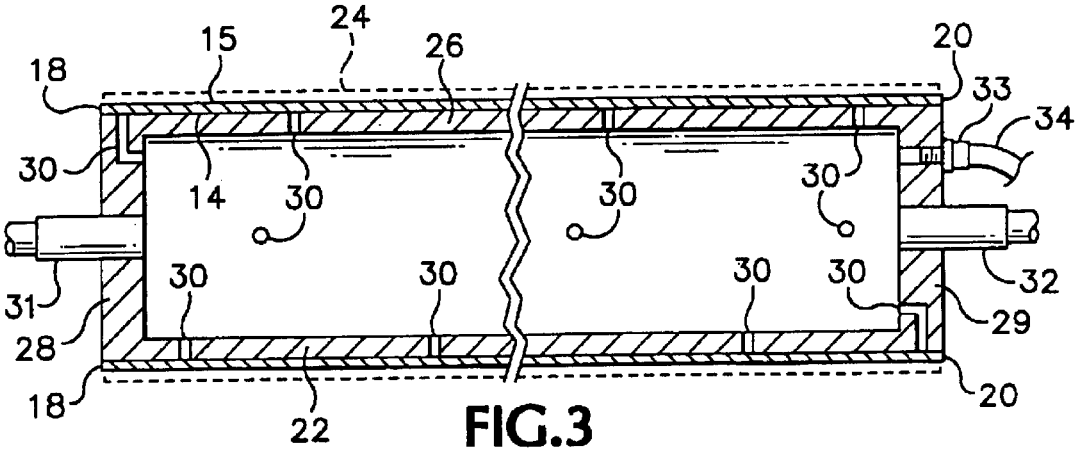
FIG. 3 is an enlarged, sectional view of the printing sleeve of FIG. 2 in use as mounted on a conventional printing cylinder.

The flexographic printing sleeve 10 shown in FIGS. 2 and 3 can be produced by the printing sleeve manufacturing system, denoted generally as "100", which is depicted in FIG.1. System 100 includes certain tools used in the formation of a printing sleeve blank (not shown), which in turn is formed into a flexographic printing sleeve 10. For example, metal mandrel 112 is used as the form onto which the polymeric material is directly sprayed. This direct spraying operation is conducted without the use of any intermediate materials or steps. This technique is highly accurate and the mandrel 112 diameters are exceptionally true. More specifically, the outer diameter of mandrel 112 exhibits a total indicated runout and circularity tolerance which is preferably within 0.0015", more preferably within 0.0010", and most preferably within 0.0005". They are drilled to be air chambers, and air pressure is used to float the sleeve 10 off of the mandrel 112 after it is sprayed. The nominal outer diameter of the mandrel 112 is precisely oversized to compensate for shrink rates of the spray material. These tools are various diameters and lengths to accommodate the printing industry needs.

A spray station 114 maintains the mandrel 112 in a horizontally-extending position, and rotates mandrel 112 at a predetermined speed to match the application rate for a given sleeve size. An exemplary spray system 122, for spraying a curable polymeric material 115 onto the mandrel 112, is a Graco Foam Cat System Model No. 973-005. The spray system 122 has a spray head 126. The orifice of the nozzles in spray system 126 have a 0.011" diameter. Air is supplied to the spray head 126 through an air dryer 134 that has a dew point of −40 degrees F.

The spray head 126 is held in a traversely-movable apparatus 136 that resembles a lathe feed assembly. Spray head 126 traverses along the axis of the spray station 114 on horizontally-extending rods 117, 119 at a predetermined rate for properly depositing spray material in layers onto mandrel 112 so that printing sleeve 10 will have a substantially unitary construction which is self-supporting. The speed of the rotating mandrel 112 is controlled by a computer system (not shown), which is D.C. motor driven by belt and pulley assembly 130.

The operation of the apparatus 136 is also controlled by a second D.C. motor driven by a belt and pulley 132.

Assembly 132 is employed to facilitate control of the thickness of each layer of polymeric spray materials 115, and the final thickness of the layers of polymeric spray material 115 which is actually applied to mandrel 112. A self-contained exhaust system 110 is used to remove all oversprayed polymeric material 115, and to keep the spray particles from being deposited onto the part.

The chemicals are a basic "A" and "B" combination which are contained in vessels 116, 118. The chemical A and B are supplied to the sprayer unit with Graco transfer pumps 120. Chemical A is typically a material such as a Burtin SE-271 isocyanate pre-polymer resin, and chemical B is typically a material such as a Burtin SE-271 polyol pre-polymer resin.

Certain process variables were identified and controlled in order to achieve the desired result. First, is the temperature. More particularly, the initial temperature of the mandrel 112, the temperature of the chemicals introduced into the spray head 126, and the temperature at which the sleeve is removed from the mandrel 112.

Second, are the spray head speeds and feed rates, particularly the following: the distance and angle of spray head 126 to the mandrel 112, the traverse rate of movement of the spray head 126 along axis 114, and the rotational speed of mandrel 112 during application of the spray material 115. Layer control of applied material 115 is controlled by an algorithm in a computer control system (not shown) which uses tool speed, feed rate and deposit rate of the spray material 115 as the process control variables.

The third variable is spray pressures and orifice sizing, particularly the following: the pressure of chemicals to the spray head (1500 psi) and the sizing of the orifice in spray head (0.011").

The fourth variable is demount and cure times, particularly the following: demount (demold) at proper time and temperature to achieve more exact diameter sizing. Due to high exotherm temperatures during spraying, no post cure is required.

The fifth variable is tool sizing, particularly the following: mandrel OD is 0.001" PER 1.00" dia. larger than finished inside diameter of the sleeve.

More specifically, in use, mandrel 112 is prepared with a mold release agent and bolt on collars for fitting into the spray station 114. The mandrel 112 is then placed into spray station 114 which is then brought up to a spray temperature, preferably about 110 to 120 degrees F. Chemicals A and B in vessels 116 and 118 are pre-mixed and preheated to the requisite spray process temperatures. Preferably, pumps 120 are brought to pressures of about 1350 to 1500 psi, and fluid lines 124 are preheated to the above-described spray temperature. The rotational speed of mandrel 112 is then adjusted to between about 15 to 25 rpm, and operation of the spray head 126 is begun, the transverse movement of the spray head 126 being selected depending on the dimensions of the specific print sleeve blank being produced.

The spraying operation begins and several pressure and temperature sensors (not shown) monitor the process to insure that consistent thickness layers of the spray 115 will be deposited onto mandrel 112. The final thickness of the spray is typically up to about 0.500", with each layer preferably being about 0.010" in thickness.

As the printing sleeve blank builds in thickness on the mandrel 112, the exotherm of the material builds the temperature of the blank until the curing process is complete. Typically, temperature of about 250 degrees F. are reached during the curing process.

Mandrel 112 is removed from the station 114 by introducing air into the mandrel to float the part off of the mandrel. The mandrel then is cooled to ambient temperature and is made ready for the next sleeve blank to be manufactured.

The printing sleeve blanks (not shown) are then remounted onto a separate, properly-sized mandrel for final machining in a standard lathe to produce the flexographic printing sleeve. Round ceramic inserts are used for the finish cut. After final finishing and quality control checking the flexographic printing sleeve is ready to ship.

Referring now to FIGS. 2 and 3, in use, a cylindrically-shaped printing sleeve 10 is provided which comprises cylindrically-shaped inner and outer walls 14 and 15 which define a hollow inner chamber 16, and a pair of end sections 18 and 20. Sleeve 10 is depicted mounted on an illustrative conventional printing cylinder 22, such as described in U.S. Pat. No. 4,903,597, which is incorporated herein by reference.

Typically, sleeve 10 will serve as a support for the application of printing indicia (not shown), preferably flexographic printing plates, which are generally made of a flexible polymeric material. Any suitable indicia for printing onto a printing medium may be set on these printing plates. Alternatively, outer wall 15 may itself be employed as the means for printing onto a printing medium. Various methods can be employed to engrave the outer wall 15. For example, one could employ chemical or photochemical engraving techniques to form the requisite means for producing the print indicia.

The printing sleeve 10 and the printing cylinder 22 are cylindrical and have a constant diameter. The outer wall 23 of the cylinder 22 has a slightly larger diameter than the inner wall 14 so that the sleeve will firmly frictionally fit onto the cylinder. The cylinder 22 is hollow and has a cylindrical chamber 25 which is used as a compressed air chamber. The cylinder 22 comprises a cylindrical tube 26 fitted with airtight endplates 28 and 29. A plurality of spaced-apart, radially-extending apertures 30 are provided in the tube 26 through which air from the chamber 25 may pass for expanding the sleeve 10 during mounting and dismounting operations.

Air is introduced into the chamber 25 through air hose 34. Trunnions 31 and 32 are provided for rotationally supporting cylinder 22. A coupling element 33 is disposed within endplate 29 and provides a means for connecting air hose 32 to cylinder 22 for introducing compressed air to the cylinder chamber 25.

What is claimed is:

1. A method for producing a flexographic printing sleeve which is readily axially mountable on and dismountable from a complementary shaped printing cylinder, which comprises:

providing an apparatus for receiving a sprayed curable polymeric material and for forming said flexographic printing sleeve;

spraying said curable polymeric material directly onto said apparatus; and curing said polymeric material and forming a flexographic printing sleeve, removing said printing sleeve from said apparatus, for mounting said sleeve onto said printing cylinder, said sleeve having a substantially unitary construction which is self-supporting, the cross-sectional inner and outer diameter of the flexographic printing sleeve being expandable by introducing a relatively low pressure fluid between an inner surface of the flexographic printing sleeve and an outer cylindrically-shaped wall of the printing cylinder, the flexographic printing sleeve being contractible from its expanded position by releasing said low pressure fluid, said flexographic printing sleeve having a structural integrity which is resistant to substantial damage or distortion.

2. The method of claim 1, wherein the temperature at which the flexographic printing sleeve is resistant to substantial damage or distortion is about 250 degrees F.

3. The method of claim 1, wherein the flexographic printing sleeve has a wall thickness of up to about 0.50".

4. The method of claim 1, wherein the polymeric material is a polyurethane-polyurea material.

5. The method of claim 1, wherein said substantially unitary construction comprises a non-laminate construction.

6. The method of claim 1, wherein the sprayable curable polymeric material comprises a non-solvent-containing sprayable curable polymeric material.

7. The method of claim 1, wherein the flexographic printing sleeve includes no auxiliary structural reinforcing materials.

8. The method of claim 1, wherein the flexographic printing sleeve is formed of a plurality of layers of said curable polymeric material which fuse together to produce said self-supporting substantially unitary construction.

9. The method of claim 1, wherein the flexographic printing sleeve includes inner and outer cylindrically-shaped walls of substantially constant cross-sectional inner and outer diameter.

10. A method for producing a cylindrically-shaped flexographic printing sleeve, the flexographic printing sleeve being readily axially mountable on and dismountable from a complementary printing cylinder, which comprises:

providing an apparatus for receiving a curable polymeric material and for forming said flexographic printing sleeve;

spraying said curable polymeric material directly onto said apparatus;

curing said curable polymeric material and forming a cured printing sleeve blank; and forming said flexographic printing sleeve from said cured printing sleeve blank, removing said printing sleeve from said apparatus, for mounting said sleeve onto said printing cylinder, said flexographic printing sleeve having a substantially unitary construction which is self-supporting, the cross-sectional inner and outer diameter of the flexographic printing sleeve being expandable by introducing a low pressure fluid between an inner surface of the flexographic printing sleeve and an outer wall of the printing cylinder, the flexographic printing sleeve being contractible from its expanded position by releasing said low pressure fluid, and the flexographic printing sleeve having a structural integrity which is resistant to substantial damage or distortion.

11. The method of claim 10, wherein the step of forming said flexographic printing sleeve from said cured printing sleeve blank comprises removing a portion of an outer surface of said cured printing sleeve blank to produce said flexographic printing sleeve.

12. The method of claim 10, wherein the temperature at which the flexographic printing sleeve is resistant to substantial damage or distortion is about 250 degrees F.

13. The method of claim 10, wherein the flexographic printing sleeve has a wall thickness of up to about 0.50".

14. The method of claim 10, wherein the polymeric material is a polyurethane-polyurea material.

15. The method of claim 10, wherein said substantially unitary construction comprises a non-laminate construction.

16. The method of claim 10, wherein the sprayable curable polymeric material comprises a non-solvent-containing sprayable curable polymeric material.

17. The method of claim 10, wherein the flexographic printing sleeve includes no auxiliary structural reinforcing materials.

18. The method of claim 10, wherein the flexographic printing sleeve is formed of a plurality of layers of said curable polymeric material which fuse together to produce said self-supporting substantially unitary construction.

19. The method of claim 10, wherein the flexographic printing sleeve comprises inner and outer cylindrically-shaped walls of substantially constant cross-sectional inner and outer diameter.

20. A method for producing a flexographic printing sleeve which is readily axially mountable on and dismountable from a complementary shaped printing cylinder, which comprises:

providing an apparatus for receiving a sprayed curable polymeric material and for forming said flexographic printing sleeve;

spraying said curable polymeric material directly onto said apparatus; and curing said polymeric material and forming a flexographic printing sleeve, removing said printing sleeve from said apparatus, for mounting said sleeve onto said printing cylinder, said sleeve having a substantially unitary construction which is self-supporting, the cross-sectional inner and outer diameter of the flexographic printing sleeve being expandable by introducing a relatively low pressure fluid between an inner surface of the flexographic printing sleeve and an outer cylindrically-shaped wall of the printing cylinder, the flexographic printing sleeve being contractible from its expanded position by releasing said low pressure fluid, the flexographic printing sleeve having a structural integrity which is resistant to substantial damage or distortion, and the average time for producing the flexographic printing sleeve being not more than about 1.0 hour.

21. A method for producing a cylindrically-shaped flexographic printing sleeve, the flexographic printing sleeve being readily axially mountable on and dismountable from a complementary printing cylinder, which comprises:

providing an apparatus for receiving a curable polymeric material and for forming said flexographic printing sleeve;

spraying said curable polymeric material directly onto said apparatus;

curing said curable polymeric material and forming a cured printing sleeve blank; and forming said flexographic printing sleeve from said cured printing sleeve blank, removing said printing sleeve from said apparatus, for mounting said sleeve onto said printing cylinder, said flexographic printing sleeve having a substantially unitary construction which is self-supporting, the cross-sectional inner and outer diameter of the flexographic printing sleeve being expandable by introducing a low pressure fluid between an inner surface of the printing body sleeve and an outer wall of the printing cylinder, the flexographic printing sleeve being contractible from its expanded position by releasing said low pressure fluid, the flexographic printing sleeve having a structural integrity which is resistant to substantial damage or distortion, and the average time for producing the flexographic printing sleeve being not more than about 1.0 hour.

* * * * *